United States Patent [19]

Hayase et al.

[11] Patent Number: 4,507,068

[45] Date of Patent: Mar. 26, 1985

[54] VANE TYPE ROTARY MACHINE

[75] Inventors: Isao Hayase, Katsuta; Atsushi Suginuma, Mito; Atsuo Kishi, Katsuta, all of Japan

[73] Assignee: Hitachi, Ltd., Tokyo, Japan

[21] Appl. No.: 411,369

[22] Filed: Aug. 25, 1982

[30] Foreign Application Priority Data

Aug. 26, 1981 [JP] Japan ..... 56-133705

[51] Int. Cl.[3] ..... F04C 18/00

[52] U.S. Cl. ..... 418/150; 418/238; 418/267

[58] Field of Search ..... 418/150, 236, 238, 266, 418/267, 268

[56] References Cited

U.S. PATENT DOCUMENTS 3,121,421 2/1964 Peterson ..... 418/150

FOREIGN PATENT DOCUMENTS 553176 1/1960 Belgium ..... 418/238

*Primary Examiner*—William R. Cline
*Assistant Examiner*—John J. McGlew, Jr.
*Attorney, Agent, or Firm*—Antonelli, Terry & Wands

[57] ABSTRACT

A vane-type rotary machine suitable for use as a compressor, pump or the like, having a cylinder provided with an inner peripheral contour expressed by an epitrochoid-like curve having at least one lobe, a cylindrical rotor contacting the inner peripheral surface of the cylinder and having a plurality of vane grooves, and vanes slidably received by respective vane grooves. The inner peripheral contour of the cylinder constituted by the epitrochoid-like curve is divided at the circumferential mid point of each of the portions where the distance between the rotor and the cylinder is minimized, and the curve is contracted in the circumferential direction by a predetermined angle to form a discontinuity corresponding to the predetermined angle. Both end points of the discontinuity is connected by an arc of the same radius as the rotor.

2 Claims, 10 Drawing Figures

VANE TYPE ROTARY MACHINE

BACKGROUND OF THE INVENTION

The present invention relates to a vane type rotary machine suitable for use as a compressor, pump or the like.

Vane type rotary machines are well known and find various uses such as compressors, pumps and so forth. Generally, a van type rotary machine includes a cylinder having an inner peripheral contour represented by an epitrochoid-like curve having n (n being a natural member) lobes, and a cylindrical rotor which contacts the inner peripheral surface of the cylinder at n points. The rotor is provided with a plurality of radial vane grooves which are communicated with one another at their bottoms. The vane grooves slidably receives vanes the ends of which are pressed against the inner peripheral surface of the cylinder. For example, as shown in FIG. 1, a vane-type rotary machine having three lobes includes a cylinder rotor 3 having an inner peripheral contour of an eptirochoid-like curve, with the cylindrical rotor 3 having vane grooves 2 for slidably accommodating vanes 4 which make resilient sliding contact with the inner peripheral surface of the cylinder 1. When this vane-type rotary machine operates as a vane-type compressor, the vanes reciprocate within the respective vane grooves 2 while sliding on an inner peripheral surface of the cylinder 1 in accordance with the rotation of the rotor 3, so that the volume of each space 5 defined by adjacent vanes 4, rotor 3 and cylinder 1 is periodically changed to thereby effect the compression.

In the rotary machine of the aforementioned type, the compression chamber is divided into sections at portions where a distance between the rotor 3 and the inner peripheral surface 1 is minimized; therefore, it is essential to preserve a good seal at such portions. An effective measure to preserve a good seal at this portion is to insure that such portions of the inner peripheral surface of the cylinder 1 have the form of a circle concentric with the cylindrical surface of the rotor over a substantial circumferential width and to form a surface seal between the cylinder 1 and the rotor 3 at each of such portions.

More particularly, as shown in FIG. 2, the inner peripheral contour assumes a continuous basic curve l contacting a circle of a given diameter at one or more points and an arc m having a radius slightly greater than the radius of the circle, with the curve l and the arc m being connected through suitable transient curves R or, alternatively, connected by common tangential lines as shown in FIG. 3.

However, since the inner peripheral contour has discontinuous portions such as transient curves R (FIG. 2) or the common tangential lines (FIG. 3), the vanes 4 sliding on the inner peripheral surface of the cylinder 1 are made to move irregularly when they pass such discontinuous portion. The irregular motion of the vanes 4 causes chattering of the vanes resulting in local wear of the vanes 4, generation of noise and other troubles.

In, for example, co-pending United States application corresponding to Japanese patent application No. 125,226/1981, a rotary machine, usable as a compressor, pump, or the like, is disclosed which includes a cylinder having an inner peripheral contour formed by a epitrochoidal curve having one or more lobes, a cylindrical rotor having a plurality of vane grooves and contacting the inner peripheral surface of the cylinder, and vanes slidably received by the respective vane grooves. The inner peripheral contour of the cylinder is modified such that the portion of the maximum expansion thereof is offset in a direction of rotation of the rotor to thereby suppress the lateral reactional force applied to the vanes to diminish the friction loss attributable to the sliding of the vanes while, at the same time, obtaining a motion of each vane approximating a sine-wave curve so as to avoid any noise, thermal loss and mechanical damage attributable to irregular motion of the vanes.

SUMMARY OF THE INVENTION

Accordingly, an object of the invention is to provide a vane-type rotary machine which has an inner peripheral contour capable of maintaining a good seal between the cylinder and the rotor at portions where the distance between the rotor and cylinder is minimized and capable of ensuring a smooth motion of the vanes at such portions.

In the vane type rotary machine of the invention, a cylinder having a predetermined inner peripheral contour is provided whereby each vane does not move longitudinally when it moves over each arcuate region, but moves in accordance with a sine-wave curve when it slides over the epitrochoid-like portion of the inner peripheral contour of the cylinder. Namely, the force acting on each vane at the terminal portion of the epitrochoidal curve is negated leaving a centrifugal force of a suitable level to relieve the vane from any excessive force, so that the vane is not pressed towards the center of the rotor by the reactional force nor moved by inertia away from the inner peripheral surface of the cylinder at each point of juncture between the curved portion and the arcuate portion of the inner peripheral contour of the cylinder. It is thus possible to obtain a movement of each vane which well approximates the motion of the vane attained in the conventional vane-type rotary machine in which the inner peripheral contour of the cylinder is constituted solely by the epitrochoid-like curve.

DETAILED DESCRIPTION OF THE INVENTION

Figure 1:
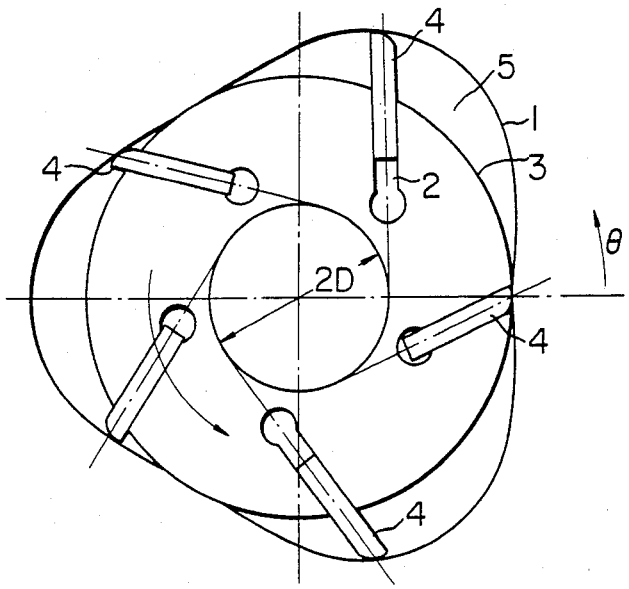
FIG. 1 PRIOR ART
FIG. 1 is a schematic view of a prior art vane-type rotary machine.
Figure 2:
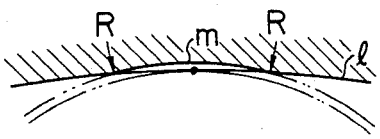
FIG. 2 PRIOR ART
FIGS. 2 and 3 are cross sectional views of portions of contours of a cylinder and rotor in a prior art vane-type rotary machine.
Figure 3:
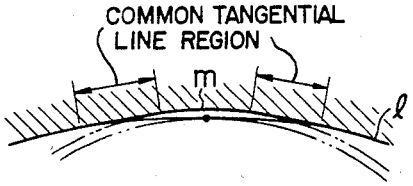
FIG. 3 PRIOR ART
Figure 4:
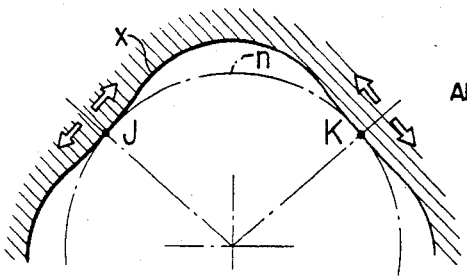
FIGS. 4 and 5 are cross sectional views of portions of contours of a cylinder and rotor in a vane-type rotary machine in accordance with the present invention.

Referring now to the drawings when like reference numerals are used throughout the various views to designate like parts and, more particularly, to FIG. 4, according to this figure, a basic continuous curve x is contacted by a circle $C_n$ at least at one of a plurality of points, and is cut at contact points J, K, with the divided segments being then contracted in a circumferential direction and interconnected by an arc y having the same radius as the circle $C_n$ to obtain a contour constituting an inner peripheral surface of the cylinder.

More particularly, according to the present invention, the inner peripheral contour of the cylinder is determined in the following manner. Namely, assuming that a closed curve contacted by an inscribed circle at n points (n−1, 2 . . . , n) is represented by the formula (a) wherein a and b represent constants, a curve expressed by formula (c) is formed at a plurality of around the inscribed circular at an angular interval of 360°/n, within the range expressed by formula (b) where $\theta_s$ represents the suitable angle, and a curve formed by interconnecting the regions corresponding to the angle $\theta_s$ by arcs coinciding with the inscribed circle is used as the inner configuration of the cylinder.

$$r = a - b\cos(n\,\theta) \tag{a}$$

$$0 \leqq \theta \leqq \frac{360}{n} - \theta_s \tag{b}$$

$$r = a - b\cos\left(\frac{360}{\frac{360}{n} - \theta_s}\cdot\theta\right) \tag{c}$$

According to the invention, the inner peripheral contour of the cylinder is determined in the following manner. Assuming that a closed curve is contacted by an inscribed circle by n points (n=1, 2, . . . , n), and assuming the x and y coordinates of points constituting the curve is given by the formulas (d) and (e), where $\theta_r$ represents a parameter while A, B, C and D represent constants.

$$x = D\sin\theta_r = (A - B\cos n\theta_r)\cos\theta_r + C\frac{D\sin\theta_r + (A - B\cos n\theta_r)\cos\theta_r + nB\sin n\theta_r\sin\theta_r}{\sqrt{D^2 + (A - B\cos n\theta_r)^2 + n^2B^2\sin^2 n\theta_r + 2nBD\sin n\theta_r}} \tag{d}$$

$$y = -D\cos\theta_r + (A - B\cos n\theta_r)\sin\theta_r + C\frac{-D\cos\theta_r + (A - B\cos n\theta_r)\sin\theta_r - nB\sin n\theta_r\cos\theta_r}{\sqrt{D^2 + (A - B\cos n\theta_r)^2 + n^2B^2\sin^2 n\theta_r + 2nBD\sin n\theta_r}} \tag{e}$$

If a suitable angle is represented by $\theta_s$, a plurality of curves may be determined by the formulae (h) and (i) arranged above the inscribed circlar and an angular intervial of 360°/n, where $\theta_r$ and n' are determined by formulae (f) and (g), respectively. Then the inner peripheral contour of the cylinder is given by interconnecting the regions corresponding to the angle $\theta_s$ by arcs conforming with the inscribed circle.

$$0 \leqq \theta_r \leqq \frac{360}{n} - \theta_s \tag{f}$$

$$n' = \frac{360}{\frac{360}{n} - \theta_s} \tag{g}$$

$$x = D\sin\theta_r + (A - B\cos n'\theta_r)\cos\theta_r + C\frac{D\sin\theta_r + (A - B\cos n'\theta_r)\cos\theta_r + n'B\sin n'\theta_r\sin\theta_r}{\sqrt{D^2 + (A - B\cos n'\theta_r)^2 + n'^2B^2\sin^2 n'\theta_r + wn'BD\sin n'\theta_r}} \tag{h}$$

$$y = -D\cos\theta_r + (A - B\cos n'\theta_r)\sin\theta_r + \tag{i}$$

-continued $$C\frac{-D\cos\theta_r + (A - B\cos n'\theta_r)\sin\theta_r - n'B\sin n'\theta_r\cos\theta_r}{\sqrt{D^2 + (A - B\cos n'\theta_r)^2 + n'^2B^2\sin^2 n'\theta_r + 2n'BD\sin n'\theta_r}}$$

Figure 6:
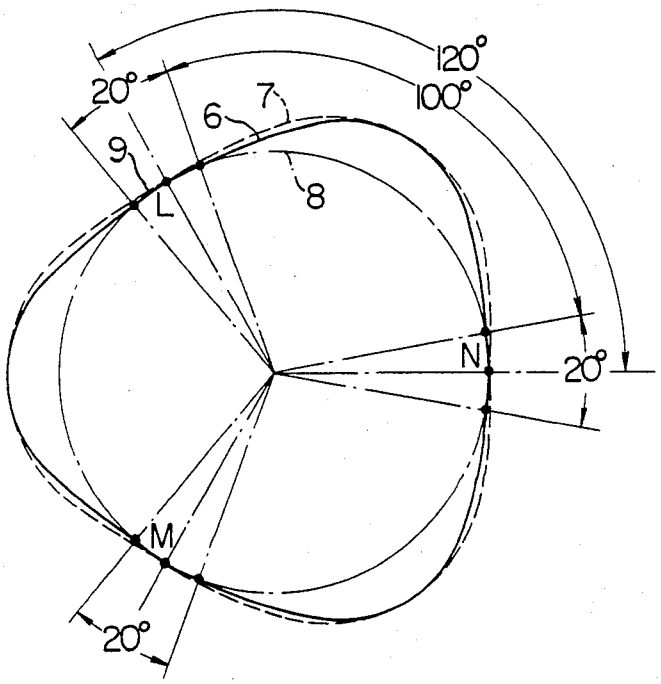
FIG. 6 is a schematic view of an inner contour of a cylinder in a vane-type rotary machine in accordance with the present invention.

As shown in FIG. 6, a moving vane-type compressor is provided with a cylinder having an inner peripheral surface 6 with a continuous curve forming a base for the inner peripheral contour, with the continuous curve 7 being expressed, in polar coordinates, by the following formula:

$$r - 40 - 4\cos(3\theta) \tag{1}$$

To form the curve 6, the continuous curve 7 is divided into three sections L, M and N a points of contact with an inscribed circle 8 having a diameter of 72 mm, with each section being contracted in the circumferential direction such that cyclic change of r from minimum to maximum and maximum to minimum which is originally completed within the angular range of 120°, is completed within 100°, and each angular region, corresponding to the angular differential of 20°, is interconnected by an arc 9 having the same diameter as the inscribed circle, i.e. 72 mm.

Figure 5:
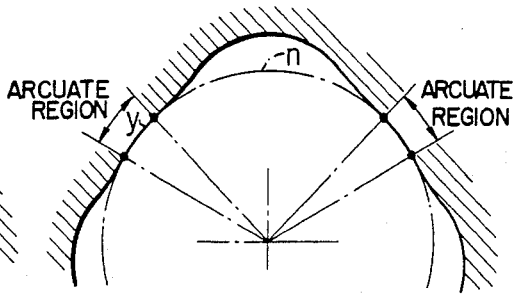

In this case, since the continuous curve 7 is cut at three points L, M and N, the tangential line to the continuous curve at each point of contact coincides with the line tangential to the inscribed circle 8. This applies also the full-line curve 6 obtained by contracting the basic curve 7 in the circumferential direction, so that each arcuate region corresponding to the angular difference of 20°, and adjacent regions of 100° are very smoothly connected. Various method can be taken for determining the circle in the circumferential direction. The embodiment of FIG. 5 employs a curve expressed by the following formula, where $\theta'$ represents an angle determined with respect to the direction expressed by $\theta = 10°$:

$$\left.\begin{aligned} r &= 40 - 4\cos\left(\frac{360}{100}\cdot\theta'\right) \\ 0 &\leqq \theta' \leqq 100(°) \end{aligned}\right\} \tag{2}$$

Similarly, an inner peripheral contour of the cylinder having an arcuate region of angle $\theta_s$ at each contact portion is determined using a curve contacted by an inscribed circle at n points expressed by formula (3) as the basic curve, wherein a and b represent constants. Namely, an inner peripheral contour is created by forming curves expressed by the formula (4) at an angular interval of 360°/n and interconnecting such curves to form a closed curve.

$$r = a - b\cos(n\theta) \tag{3}$$

-continued $$\left.\begin{array}{l}\text{where:}\\ 0 \leqq \theta \leqq \frac{360}{n} - \theta_s,\\ r = a - b\cos\left(\frac{360}{\frac{360}{n} - \theta_s}\cdot\theta\right)\text{; and}\\ \text{where:}\\ \frac{360}{n} - \theta_s \leqq \theta \leqq \frac{360}{n},\\ r = a - b\end{array}\right\} \quad (4)$$

To generate the inner peripheral contour of the cylinder it is assumed that a closed curve contacted at n points by an inscribed circle of a diameter D is expressed, in polar coordinates, by the formula (5), with the inner contour of the cylinder being formed by arranging the curves expressed by the following formula at an angular interval of 360°/n and with such curves being interconnected to form a closed curve.

$$\left.\begin{array}{l} r = r(n\theta)\\ r_{min} = D/2\end{array}\right\} \quad (5)$$

$$\left.\begin{array}{l}\text{where}\\ 0 \leqq \theta \leqq \frac{360}{n} - \theta_s,\\ r = r\left(\frac{360}{\frac{360}{n} - \theta_s}\cdot\theta\right)\text{; and}\\ \text{where:}\\ \frac{360}{n} - \theta_s \leqq \theta \leqq \frac{360}{n},\\ r = D/2\end{array}\right\} \quad (6)$$

According to this method, it is possible to obtain an inner peripheral contour of a cylinder in which arcuate portions, each having an angular region of $\theta_s$ is very smoothly connected to the intermediate regions forming the compression chambers.

In the vane-type rotary machine incorporating a cylinder having an inner peripheral contour determined as above, it is possible to attain a good internal seal and, hence, superior performance, while ensuring a long life of the vanes by permitting the same to move highly smoothly, because each portion where the distance between the rotor and the cylinder, constituted by an arc concentric with the rotor, is minimized is connected very smoothly connected to adjacent regions constituting the compression chambers.

Figure 7:
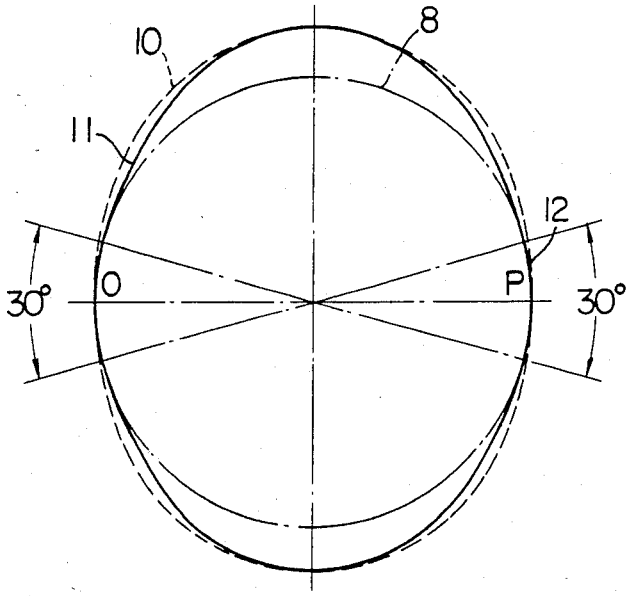
FIGS. 7–10 are schematic views of different embodiments of a vane-type rotary machine constructed in accordance with the present invention.

As shown in FIG. 7, a basic curve 10 constituted by points x and y is expressed by the formula (7), where n represents an integer (n being two in this case), with a parameter $\theta_r$, while A, B, C and D express constants. The inner preiperhal contour of the cylinder of this embodiment is formed as a curve 11 which is determined as follows. Namely, this inner peripheral contour is created by forming curves expressed by the formula (8) by substituting n'=360/180−30=12/5, for n=2 in formula (7) so that the arc forming the region $\theta_s$=30° around the contact points O and P conforms with the inscribed circle 8, arranging the curves expressed by the formula (8) at an angular interval of 180° and interconnecting these curves by arcs 12 having a radius expressed by $$\sqrt{D^2 + (A - B)^2 + C}\ .$$

$$\left.\begin{array}{l} x = D\sin\theta_r + (A - B\cos n\theta_r)\cos\theta_r + \\ \quad C\dfrac{D\sin\theta_r + (A - B\cos n\theta_r)\cos\theta_r + nB\sin n\theta_r\sin\theta_r}{\sqrt{D^2 + (A - B\cos n\theta_r)^2 + n^2B^2\sin^2 n\theta_r + 2nBD\sin n\theta_r}}\\ y = -D\cos\theta_r + (A - B\cos n\theta_r)\sin\theta_r + \\ \quad C\dfrac{-D\cos\theta_r + (A - B\cos n\theta_r)\sin\theta_r - nB\sin n\theta_r\cos\theta_r}{\sqrt{D^2 + (A = B\cos n\theta_r)^2 + n^2B^2\sin^2 n\theta_r + 2nBD\sin n\theta_r}}\end{array}\right\} \quad (7)$$

$$\left.\begin{array}{l} x' = D\sin\theta_r + CA - B\cos\frac{12}{5}\theta_r\Big)\cdot\cos\theta_r + \\ \quad C\cdot\dfrac{D\sin\theta_r + \left(A - B\cos\frac{12}{5}\theta_r\right)\cos\theta_r + \frac{12}{5}B\sin\frac{12}{5}\theta_r\sin\theta_r}{\sqrt{D^2 + \left(A - B\cos\frac{12}{5}\theta_r\right)^2 + \left(\frac{12}{5}\right)^2 B^2\sin^2\frac{12}{5}\theta_r + \frac{24}{5}BD\sin\frac{12}{5}\theta_r}}\end{array}\right\}$$

-continued $$\left.\begin{aligned} y = {} & -D\cos\theta_r + \left(A - B\cos\frac{12}{5}\theta_r\right)\sin\theta_r + \\ & C\frac{-D\cos\theta_r + \left(A - B\cos\frac{12}{5}\theta_r\right)\sin\theta_r - \frac{12}{5}B\sin\frac{12}{5}\theta_r\cos\theta_r}{\sqrt{D^2 + \left(A - B\cos\frac{12}{5}\theta_r\right)^2 + \left(\frac{12}{5}\right)^2 B^2\sin^2\frac{12}{5}\theta_r + \frac{24}{5}BD\sin\frac{12}{5}\theta_r}} \end{aligned}\right\} \quad (8)$$

$$\theta \leqq \theta_r \leqq 150$$

Similarly, for obtaining the inner peripheral contour of the cylinder having at least one lobe, the term n in formula (7) is substituted by n' which is given as $n' = 360/(360/n) - \theta_s$ as expressed by the formula (9) to obtain a curve, and such curves are arranged in angular interval of 360°/n and interconnected by arcs of a radius expressed by $$\sqrt{D^2 + (A - B)^2 + C}.$$

$$\left.\begin{aligned} x = {} & D\sin\theta_r + (A - B\cos n'\theta_r)\cos\theta_r + \\ & C\frac{D\sin\theta_r + (A - B\cos n'\theta_r)\cos\theta_r + n'B\sin n'\theta_r\sin\theta_r}{\sqrt{D^2 + (A - B\cos n'\theta_r)^2 + n'^2B^2\sin^2 n'\theta_r\, 2n'B\, D\sin n'\theta_r}} \\ y = {} & -D\cos\theta_r + (A - B\cos n'\theta_r)\sin\theta_r + \\ & C\frac{-D\cos\theta_r + (A - B\cos n'\theta_r)\sin\theta_r - n'B\sin n'\theta_r\cos\theta_r}{\sqrt{D^2 + (A - B\cos n'\theta_r)^2 + n'^2B^2\sin^2 n'\theta_r\, 2n'B\, D\sin n'\theta_r}} \end{aligned}\right\} \quad (9)$$

Figure 8:
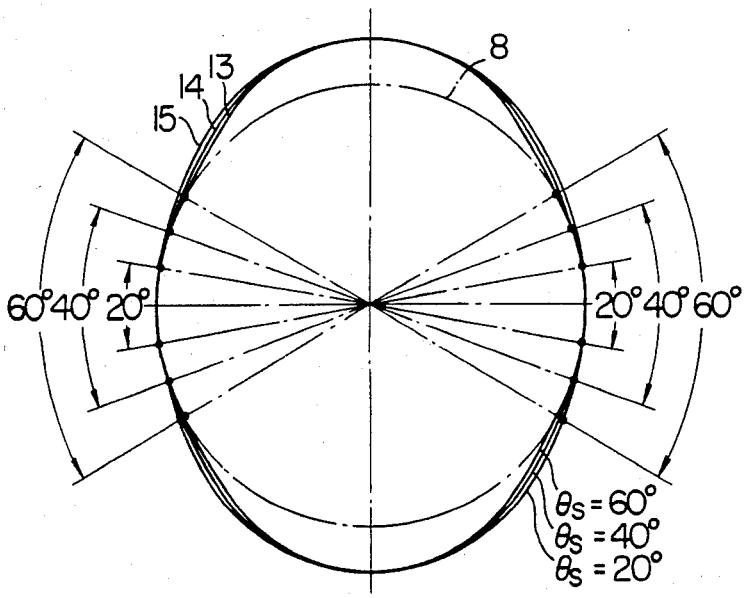

In FIG. 8, the full-line curves 13, 14 and 15 show the inner peripheral contours of the cylinder obtained when the angle $\theta_s$ is 20°, 40° and 60°, respectively, while the number of lobes is two, in the formula (7). It will be understood that the circumferential width of the arcuate portion is increased to provide higher sealing effect as the angle $\theta_s$ is increased. The greater angle $\theta_s$ also ensures also a smoother connection between the each arcuate portion and adjacent curved portions of the inner peripheral contour of the cylinder.

Figure 9:
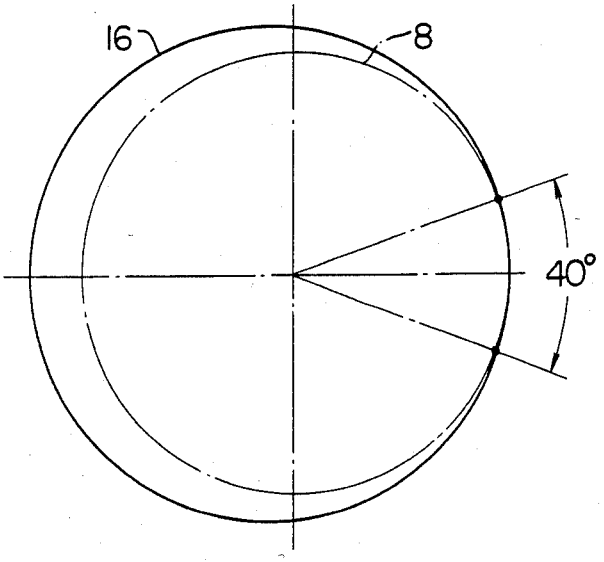
Figure 10:
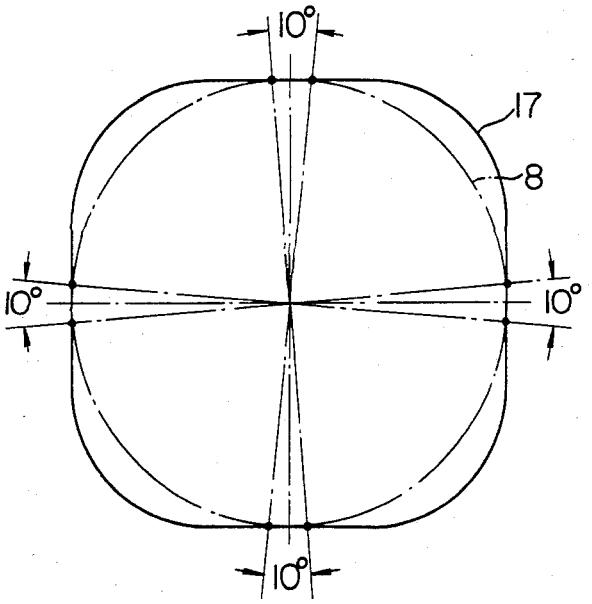

In FIGS. 9 and 10 curves 16 and 17 show, respectively, the inner peripheral contours of the cylinder as obtained when the angle $\theta_s$ takes a value of 40°, while the number n of the lobe is one and when the angle $\theta_s$ takes a value of 20° while the number n of lobes is four.

The inner peripheral contours of the cylinder as shown in FIGS. 7 to 10 offer the same advantage as that provided by the inner peripheral contour shown in FIG. 6. Namely, the advantage of the invention can be equally attained with any desired values for the number n of the lobes and the angle $\theta_s$.

As will be understood from the foregoing description, according to the invention, it is possible to obtain a vane-type rotary machine in which a superior surface sealing effect is achieved in each region of the minimum distance between the cylinder and the rotor to permit a smooth sliding motion of the vanes, and hence, a higher performance of the machine while attaining a longer life of the machine.

What is claimed is:

1. A vane-type rotary machine having a cylinder provided with an inner peripheral contour expressed by an epitrochoid-like curve having at least one lobe, a cylindrical rotor having a plurality of vane grooves adapted to contact an inner peripheral surface of said cylinder, and vanes adapted to slide in said vane grooves while making sliding contact with the inner peripheral surface of said cylinder, said rotary machine having at least one portion where a distance between the inner peripheral surface of said cylinder and an outer peripheral surface of said rotor is minimized, an inner peripheral contour of said cylinder is determined a closed curve constituting an inner peripheral contour of said cylinder:

$$r = a - b\cos(n\theta),$$

where:

n represents a number of points of contact with the outer peripheral surface of the rotor; and a and b represent constants;

curves are formed at a plurality of positions around a center of an inscribed circle at an angular interval of 360°/n in accordance with the relationship:

$$r = a - b\cos\left(\frac{360}{\frac{360}{n} - \theta_s}\cdot\theta\right),$$

within a range of an angle $\theta$ expressed by:

$$0 \leqq \theta \leqq 360/n - \theta_s,$$

where: $\theta_s$ represents a suitable angle; and wherein adjacent curves are connected through arcs conforming with the portions of said inscribed circle, said arcs constituting the portions of said inner peripheral contour corresponding to said angle $\theta_s$.

2. A vane-type rotary machine having a cylinder provided with an inner peripheral contour expressed by an epitrochoid-like curve having at least one lobe, a cylindrical rotor having a plurality of vane grooves and contacting an inner peripheral surface of said cylinder, and vanes adapted to slide in said vane grooves while making sliding contact with the inner peripheral surface of said cylinder, said rotary machine having at least one portion where a distance between the inner peripheral surface of said cylinder and an outer peripheral surface of said rotor is minimized; the inner peripheral contour of said cylinder is determined by represents x and y coordinate values of points constituting a closed curve forming the inner peripheral contour of said cylinder with a parameter $\theta_r$ by the following relationship:

$$x = D\sin\theta_r + (A - B\cos n\theta_r)\cos\theta_r + C\frac{D\sin\theta_r + (A - B\cos n\theta_r)\cos\theta_r + n\,B\sin n\theta_r\sin\theta_r}{\sqrt{D^2 + (A - B\cos n\theta_r)^2 + n^2B^2\sin^2 n\theta_r + 2n\,B\,D\sin n\theta_r}}$$

$$y = -D\cos\theta_r + (A - B\cos n\theta_r)\sin\theta_r + C\frac{-D\cos\theta_r + (A - B\cos n\theta_r)\sin\theta_r - n\,B\sin n\theta_r\cos\theta_r}{\sqrt{D^2 + (A - B\cos n\theta_r)^2 + n^2B^2\sin^2 n\theta_r + 2n\,B\,D\sin n\theta_r}}$$

where:

n represents a number of points of contact with the outer peripheral surface of the rotor, A, B, C and D represent constants;

curves are formed at a plurality of portions around a center of an inscribed circle at an angular interval of 360°/n in accordance with the relationship:

$$x = D\sin\theta_r + (A - B\cos n'\theta_r)\cos\theta_r + C\frac{D\sin\theta_r + (A - B\cos n'\theta_r)\cos\theta_r + n'B\sin n'\theta_r\sin\theta_r}{\sqrt{D^2 + (A - B\cos n'\theta_r)^2 + n'^2B^2\sin^2 n'\theta_r + 2n'B\,D\sin n'\theta_r}}$$

$$y\,[+] \equiv -D\cos\theta_r + (A - B\cos n'\theta_r)\sin\theta_r + C\frac{-D\cos\theta_r + (A - B\cos n'\theta_r)\sin\theta_r - n'B\sin n'\theta_r\cos\theta_r}{\sqrt{D^2 + (A - B\cos n'\theta_r)^2 + n'^2B^2\sin^2 n'\theta_r = 2n'B\,D\sin n'\theta_r}}$$

within a range of the angle $\theta_r$ is expressed by:

$$0 \leqq \theta_r \leqq \frac{360}{n} - \theta_s$$

where;

$\theta_s$ represents a suitable angle, and where n′ is determined in accordance with the relationship:

$$n' = \frac{360}{\frac{360}{n} - \theta_s}$$

and wherein the adjacent curves are connected through arcs conforming with parts of said inscribed circle, said arcs constituting the portions of said inner peripheral contour corresponding to said angle $\theta_s$.

* * * * *